US005158495A

United States Patent [19]

Yonezawa

[11] Patent Number: 5,158,495

[45] Date of Patent: Oct. 27, 1992

[54] REMOTELY-CONTROLLED VEHICLE AND CONTROLLER

[75] Inventor: Shigeru Yonezawa, Tokyo, Japan

[73] Assignee: Yonezawa Corporation, Tokyo, Japan

[21] Appl. No.: 619,003

[22] Filed: Nov. 28, 1990

[30] Foreign Application Priority Data

Feb. 6, 1990 [JP] Japan ..... 2-10219[U]

[51] Int. Cl.[5] ..... A63H 17/00

[52] U.S. Cl. ..... 446/456; 446/454

[58] Field of Search ..... 446/1, 431, 436, 454, 446/456

[56] References Cited

U.S. PATENT DOCUMENTS

| | | | |
|---|---|---|---|
| 4,166,338 | 9/1979 | Asano | 446/456 |
| 4,188,750 | 2/1980 | Lohr | 446/454 X |
| 4,327,517 | 5/1982 | Schwager | 446/454 X |
| 4,563,626 | 1/1986 | Ohtake | 446/454 X |
| 4,612,472 | 9/1986 | Kakizake et al. | 446/454 X |
| 4,943,256 | 7/1990 | Symons | 446/456 X |

FOREIGN PATENT DOCUMENTS

| | | | |
|---|---|---|---|
| 3008604 | 9/1981 | Fed. Rep. of Germany | 446/456 |
| 2219873 | 12/1989 | United Kingdom | 446/456 |

*Primary Examiner*—Robert A. Hafer
*Assistant Examiner*—Sam Rimell
*Attorney, Agent, or Firm*—Jacobson, Price, Holman & Stern

[57] ABSTRACT

A radio controlled toy has a transmitter and a model vehicle as a counterpart receiver. The model vehicle has a built-in rechargeable battery, and the transmitter is equipped with a device for recharging the vehicle battery. Also, a resonator mounted in the model vehicle can be replaced directly from outside. Consequently, the invention allows recharging of the battery of the model vehicle and replacement of the resonator to be performed easily at a site where the model vehicle is used.

1 Claim, 4 Drawing Sheets

REMOTELY-CONTROLLED VEHICLE AND CONTROLLER

FIELD OF INVENTION

This invention relates to a remotely-controlled toy constituted by a transmitter/receiver that comprises a transmitter which generates a specific set of remote control signals and a receiver in the form of a model vehicle which is controlled by the specific set of remote control signals generated by the transmitter. More specifically, the invention relates to a remotely-controlled toy wherein the transmitter is equipped with a device for recharging a rechargeable battery incorporated in the model vehicle, thereby facilitating recharging of the vehicle batter in situ where the model vehicle is used. The invention also relates to a remotely-controlled toy wherein a resonator mounted in the model vehicle is so constructed as to be accessible and replaceable by hand, thus facilitating replacement of the resonator in situ without having to use tools or to disassemble any part of the model vehicle.

DESCRIPTION OF THE PRIOR ART

A remotely-controlled toy constituted by a transmitter/receiver which comprises a transmitter that generates a specific set of remote control signals and a model vehicle controlled by the specific set of remote control signals is already known. The toy is used in such manner that a number of transmitters which generate different specific sets of remote control signals and an equal number of model vehicles forming counterparts to the transmitters are each individually controlled by its counterpart transmitter. An example of such applications is a game in which the toys are run on a particular racing course and complete with each other in running time. This conventional sort of model vehicle has a built-in rechargeable battery to drive the vehicle. The battery consumes its electrical energy with the running time of the model vehicle in which it is incorporated and it eventually ceases to function. It is then necessary to recharge the battery. The conventional sort of recharging device is powdered by a commercial power supply and is separately encased from the transmitter. Such a recharging device, therefore, cannot be used to recharge remotely-controlled model vehicles at on site and outdoor running of such model vehicles requires players either to have their model vehicle recharged indoors prior to use or to bring with them a certain number of recharged spare batteries to the site where they are used. In addition to this disadvantage, in order to allow a number of players to run their own model vehicles at almost the same time and on an individual basis, each of the counterpart transmitters must generate a different specific set of remote control signals at almost the same time and each of receivers must receive the signal generated by its counterpart transmitter at almost the same time. At a site where a number of model vehicles are run, therefore, it is often necessary for some players to replace the resonator of their transmitter and receiver with one having a different oscillation frequency. The resonator is, however, mounted on connectors supported on a printed circuit board in such a manner that it can be only removed or mounted from above the printed circuit board fitted on the upper side of the chassis of the model vehicle. Replacement of the resonator, therefore, requires tools to remove and fit the case cover from and to the chassis of the model vehicle each time the necessity for replacement arises. For this reason, the conventional remote-controlled toy has the disadvantage that tools has the disadvantage that tools as well as time-consuming work is needed for replacement of a resonator.

SUMMARY OF THE INVENTION

In order to overcome the disadvantages of the conventional remote-controlled toys, the present invention includes a device for recharging the model vehicle's built-in battery in a transmitter with which the model vehicle is controlled, thus facilitating recharging operations at a site at which the model vehicle is used. Further, the chassis of the model vehicle is provided with a through hole for replacing the resonator, thus allowing the resonator to be replaced directly by hand without having to remove the case cover.

The invention accordingly provides a remotely-controlled toy comprising a transmitter which generates a specific set of remote control signals and a model vehicle controlled by the specific set of remote control signals generated by the transmitter, wherein the model vehicle has a built-in rechargeable battery and the transmitter is equipped with a device for recharging the secondary battery. This facilitates recharging of the model vehicle's battery at a site where the model vehicle is run. Further, the invention provides a remotely-controlled toy comprising a transmitting which generates a specific set of remote control signals and a model vehicle controlled by the specific set of remote control signals generated by the transmitter, wherein the chassis of the vehicle is perforated with a through-hole for replacing the resonator. This allows the resonator to be replaced easily and quickly by hand without having to use tools.

BRIEF DESCRIPTION OF THE DRAWINGS

Brief description will be given to the accompanying drawings of a preferred embodiment of the present invention, wherein.

DESCRIPTION OF PREFERRED EMBODIMENT

In order that this invention may be readily carried into effect, it will be described in more detail with reference to the accompanying drawings. By way of illustration only, a preferred embodiment of the invention takes the form of a radio-controlled model car.

Figure 1:
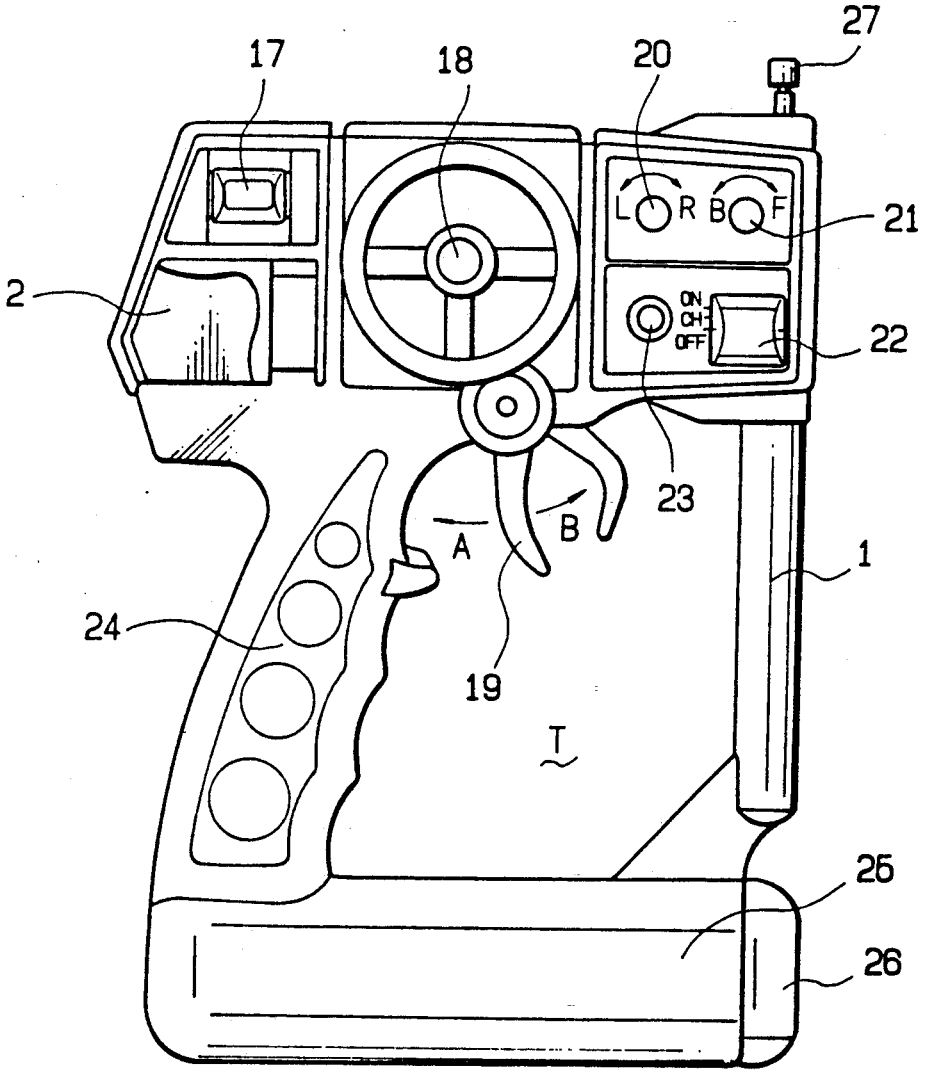
FIG. 1 is a front view of a transmitter part of a toy according to the invention.
Figure 2:
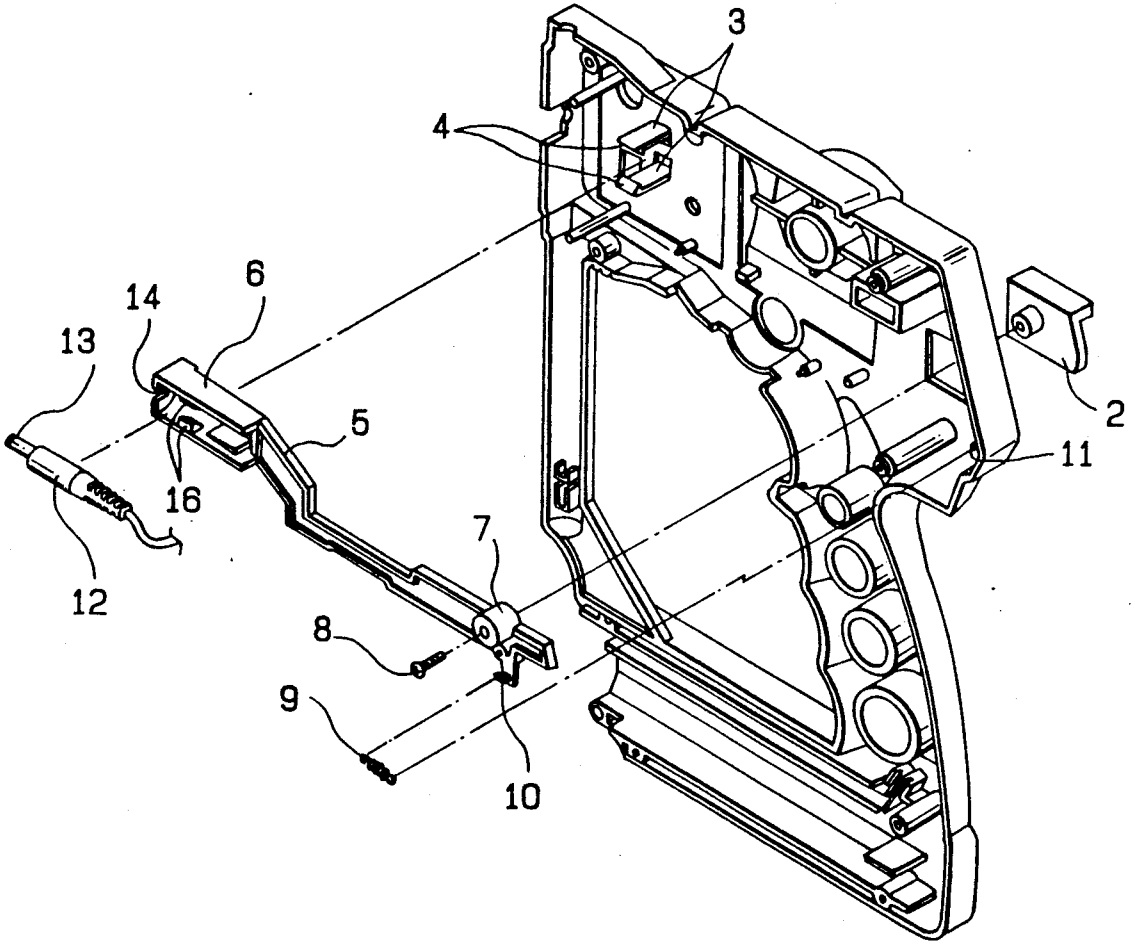
FIG. 2 is an exploded perspective view of a part of the transmitter.
Figure 4:
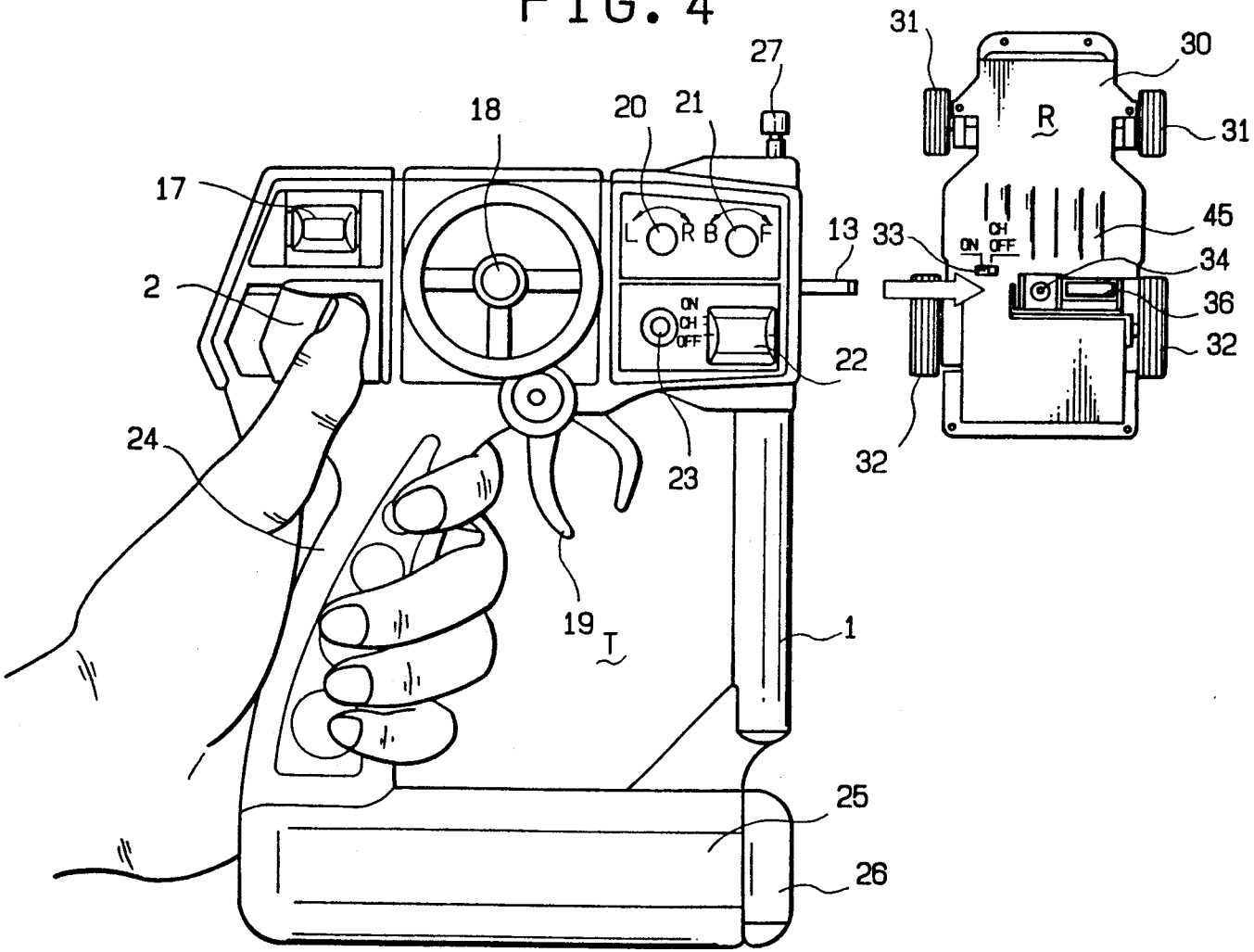
FIG. 4 is a view of the complete toy showing how the transmitter is used to recharge the remotely-controlled vehicle.

Firstly, description will be given to a transmitter (T) with reference to in FIGS. 1, 2 and 4. In these figures, 1 is a case assembly with front and back case components jointed together; 2 is a charging lever which is positioned in an upper back part of the case assembly 1 in such manner that it can slide back and forth; and 3 are opposed guide members which protrude, as shown in FIG. 2, from an inside surface of the front case component.

Each of the guide members has an engaging hook section at its free end. A slider 5 has a front end 6 which is held between the guide members 3 in such manner that it can slide back and forth. The back end 7 of the slider is fixed to the charging lever 2 by means of a screw for example. A spring 9 has one end fitted to a protrusion 10 at the back end 7 of the slider 5, and the other end of the spring is fitted to a protrusion 11 on the inside surface of the front case component. A known form of charging plug assembly 12 is fixed at the front end 6 of the slider 5. In order to fix the charging plug assembly, a fitting hole 14 is provided at the front end 6 of the slider to receive the plug 13 of the charging plug assembly 12, and members 16 are provided to hold the circumference of the charging plug assembly 12 firmly in position. The plug 13 is inserted in the fitting hole 14, and with the plug protruded from the front end 6 of the slider 5, the plug assembly 12 is firmly held in position by the holding members 16. (As in conventional transmitters, the plug 13 is connected to a battery in the transmitter.) Thus the charging plug assembly 12 is fixed at the front end 6 of the slider 5. A cap 17 covers a crystal resonator (hereinafter referred to as resonator), the resonator being contained in the case assembly in such manner that it can be replaced. A steering wheel 18 controls a known steering mechanism of a model car R which will be described later. The steering wheel 18 is supported in the upper central part of the case assembly 1 in such manner that it can rotate therein. Steering, for example, of front wheels of the model car R to the right or left is implemented by rotating the steering wheel 18 to the right or left. A throttle trigger 19 is cammed in a lower part of the case assembly below the steering wheel 18 in such manner that it can be pivoted in the directions of arrows A and B. The throttle trigger is elastically held by a spring so that it returns to a neutral position after it is actuated. A known steering trim 20 is provided in the upper front section of the case assembly 1 in such manner that it can rotate both clockwise and counterclockwise. The steering trim 20 finely adjusts the neutral position of the steering mechanism of the car R as will be described later. A known throttle trim 21 is also provided in the upper front part of the case assembly 1 in such manner that it can rotate both clockwise and counterclockwise. The throttle trim 21 fine-adjusts the neutral position of the throttle trigger. A switch 22 is provided for selecting an operating mode of the transmitter. The switch 22 is placed in the upper front part of the case assembly 1, and has three positions; namely OFF; Charge (CH); and ON. A pilot light 23 is fitted adjacent the switch 22. The pilot light turns on when the switch 22 is in the ON position, turns off when the switch 22 is in the OFF position, and turns on and off when the switch 22 is in the CH position. The pilot light also turns on and off when the capacity of a battery, which will be described later, falls below a specified level. A grip 24 is provided on the central back part of the case assembly 1, and a section 25 to accommodate batteries is provided at the bottom of the case assembly 1, which section 25 is provided with a hatch 26. A known form of rod-type antenna 27 is also provided.

Figure 3:
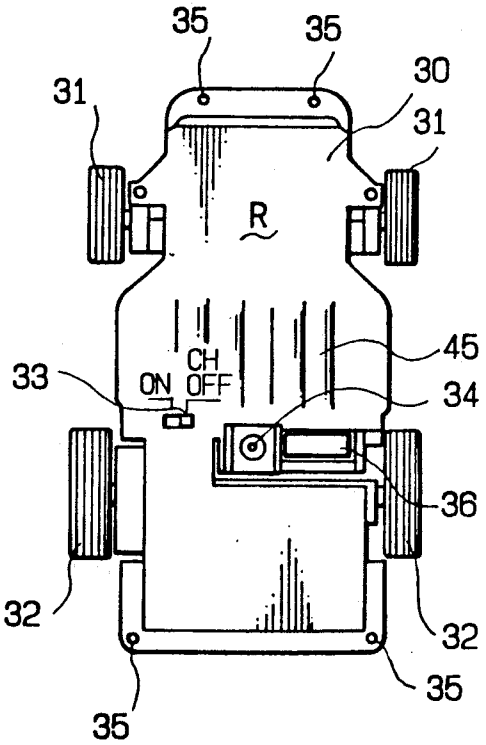
FIG. 3 is a bottom plan view of a model vehicle part of the toy.
Figure 5:
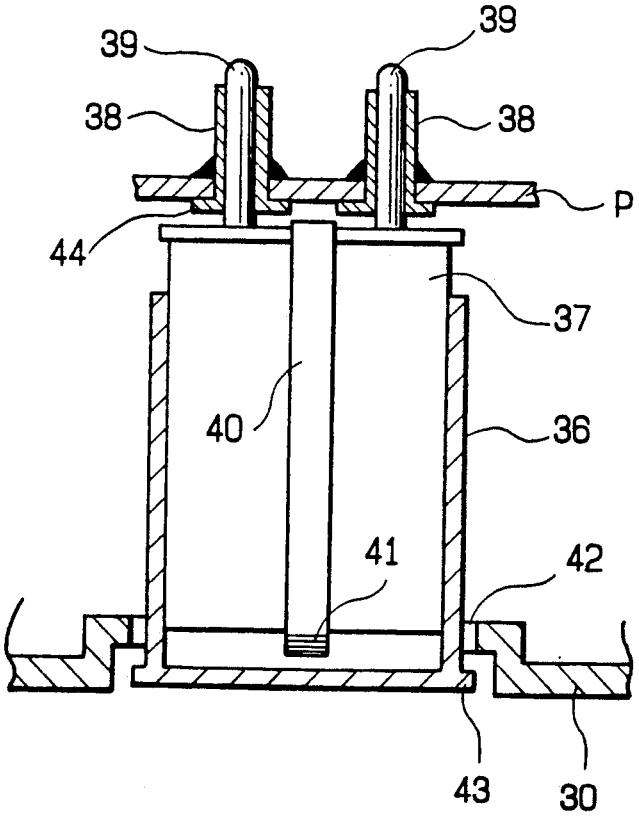
FIG. 5 is a sectional view, on an enlarged scale, of a resonator mounted in the vehicle.

The model car R comprises a receiver which forms a counterpart of the above-described transmitter T. As shown in FIGS. 3 and 5, 30 is a chassis of the car R, and 31 and 32 are front and rear wheels, respectively. A main switch 33 on the model car has two operating modes; namely ON and Charge (CH)/OFF. A known charging jack 34 is provided along with screw holes 35 to mount a car body onto the upper part of the chassis 30 in such manner that the body can be removed and fitted. A crystal resonator 37 (FIG. 5) which is exposed at the lower side of the chassis 30 is provided with a cap 36. FIG. 5 shows the interrelation between the resonator 37, chassis 30, a printed circuit board P and a connector 38 for the resonator mounted on the printed circuit board P. In this figure, the printed circuit board P is supported on the upper side of the chassis 30 in such manner that it can be removed and fitted, and it is fitted with connectors 38 for the resonator by means of, for example, soldering. The connectors 38 for the resonator have a collar 44 at their bottom and they also have a section deformed, for example by pressure, so that they can hold the resonator. The resonator has pins 39 which, when inserted into the connectors 38, are electrically connected with the circuit pattern formed on the printed circuit board P, and at the same time, the deformed section of the connectors 38 hold the pointed ends of the pins. A band 40 with a tab, is provided to enclose the resonator vertically and to pull out the resonator for replacement. A hole 42 for replacing the resonator is formed in a portion of the chassis 30 that corresponds to the position of the connectors 38.

When the resonator 37 is to be pulled out of the connectors 38, the protrusion 43 of the cap 36 which is exposed in the hole for replacing the resonator can be pulled out, for example, by hand, toward the lower end, namely the outside, of the chassis 30, and only the cap will be pulled out. Alternatively, both the cap and the resonator 37 can be pulled out. In the former case, the resonator 37 and the connectors 38 can be decoupled by pulling on the tab 41 between one's fingers, thus allowing replacement of the resonator with one having a different oscillation frequency.

The replacement of the resonator is intended to prevent a player's model car R from being controlled by another player's remote control signals when a number of players run their cars R at the same time.

The connectors 38 may have a different construction from that described above, and standard and other commercially available connectors, for example, may be used. The connectors should have the ability to hold the pins of the resonator in position.

The procedure for recharging the car battery, for example, a nickel cadmium battery, accommodated in the section 45 of the model car R, by means of the transmitter T will now be described. Initially, the switch 22 should be set to the CH position; the lever 2 of the transmitter T should be slid forward against the spring 9, as shown in FIG. 4, and the slider 5 will slide in the same direction with the guide member 3 as a guide. This will push the plug 13 of the charging plug assembly 12 out of the front end of the transmitter, namely the case assembly 1. The switch 33 of the mode car R should be set to the CH/OFF position. Insertion of the plug 13 of the transmitter into the charging jack 34 of the model car R will then start recharging of the nickel cadmium battery. While the battery is recharged, the lamp 23 turns on and off. The lamp 23 will show a steady in about 45 seconds, which indicates the completion of the recharging process.

Thereafter, the switch 22 of the transmitter T should be returned to the OFF position, and concurrently, the charging lever 2 should be released, which will actuate the spring 9 to return the slider to the original position with the guide member 4 as a guide. The plug 13 will resume its original position inside the case assembly 1, and the charging lever 2 will be returned to the original position, with the transmitter T ready to start the next round of recharging procedures as well as to perform its function as a transmitter.

On the completion of recharging of the car battery, the model car R is ready to be controlled by the transmitter.

Although the embodiment of the present invention described herein is in the form of model car, this invention can also apply to a model plane, a model ship and other model vehicles.

As described hereinabove, a remotely-controlled toy that represents the present invention has great possibilities of industrial use as a device for recharging a battery contained in a model vehicle and as a mechanism for replacing a crystal resonator included in the model vehicle.

I claim:

1. A remotely-controlled toy comprising a transmitter which generates a specific set of remote control signals and a model vehicle which is controlled by the specific set of remote control signals generated by said transmitter, characterized in that said model vehicle has a built-in rechargeable battery and that said transmitter is equipped with a device for recharging said battery including a plug and a means for extending and retracting said plug into said transmitter, the toy vehicle having a casing with a charging jack for receiving the plug when the plug is extended from the transmitter.

* * * * *